US008733988B2

(12) United States Patent
Huang et al.

(10) Patent No.: US 8,733,988 B2
(45) Date of Patent: May 27, 2014

(54) ADJUSTABLE SENSE LAMP

(71) Applicants: Tsun-Yu Huang, Changhua (TW); Cheng-Yi Huang, Changhua (TW)

(72) Inventors: Tsun-Yu Huang, Changhua (TW); Cheng-Yi Huang, Changhua (TW)

( * ) Notice: Subject to any disclaimer, the term of this patent is extended or adjusted under 35 U.S.C. 154(b) by 0 days.

(21) Appl. No.: 13/646,006

(22) Filed: Oct. 5, 2012

(65) Prior Publication Data

US 2014/0098548 A1 Apr. 10, 2014

(51) Int. Cl.
*F21S 8/00* (2006.01)

(52) U.S. Cl.
USPC ..... 362/421; 362/269; 362/287; 362/372; 362/427; 362/650

(58) Field of Classification Search
USPC ..... 362/372, 641–642, 647–652, 269, 285, 362/287, 418–419, 421, 427
See application file for complete search history.

(56) References Cited

U.S. PATENT DOCUMENTS 6,280,042 B1 * 8/2001 Wegrzyn et al. ..... 362/20
7,832,917 B2 * 11/2010 Chien ..... 362/641

* cited by examiner

*Primary Examiner* — Sean Gramling
(74) *Attorney, Agent, or Firm* — Jackson IPG PLLC

(57) ABSTRACT

An adjustable sense lamp includes a bowl-shaped seat connected with a power supply device and a lamp base having a light source, a sensor, a wire control panel and a power wire extending forward. The bowl-shaped seat includes a pair of semicircular seat pieces to form a bowl trough, spaced grooves on the inner middle walls of the seat pieces to form an annular groove for insertion a pair of limit protrusions at two opposing sides of a ball-shaped head of the lamp base. The sense lamp can be pulled upward and downward and turned to a desired angle.

1 Claim, 7 Drawing Sheets

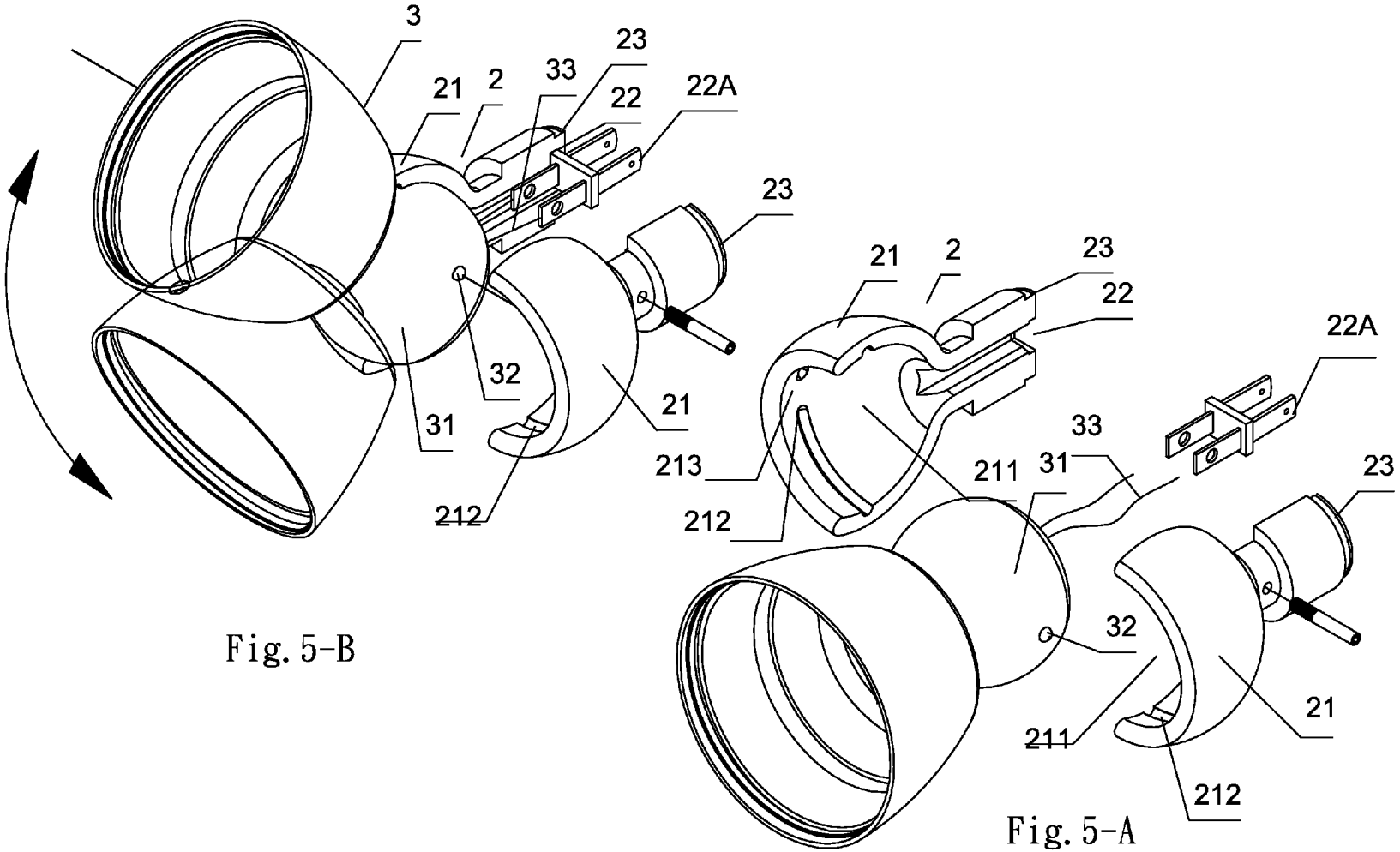
Fig. 5-A
Fig. 5-B

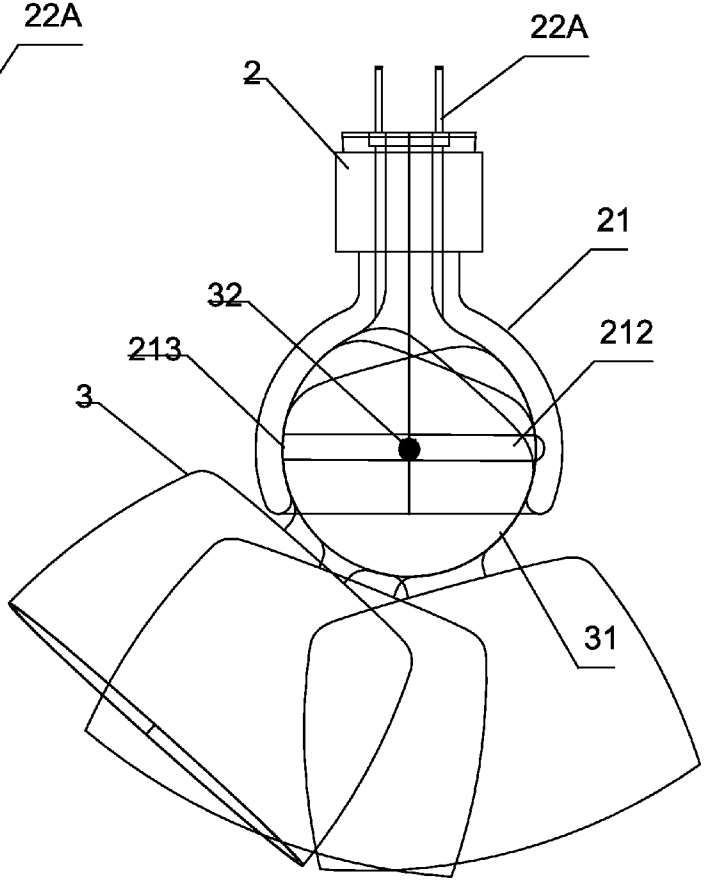
Fig. 6-B
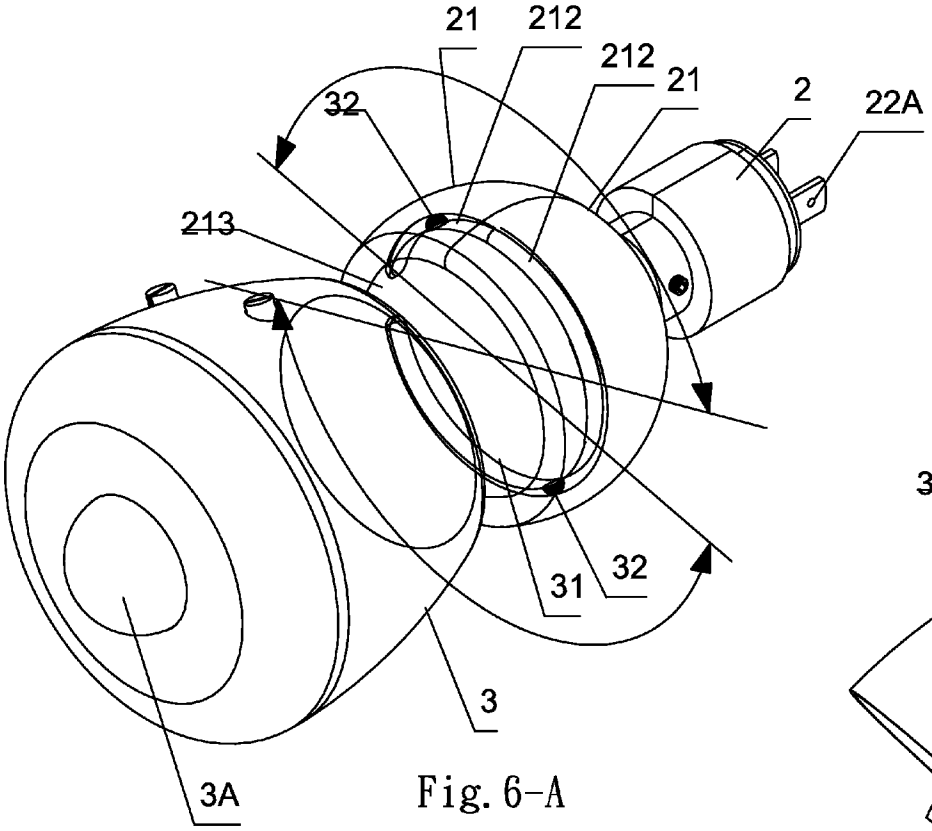
Fig. 6-A

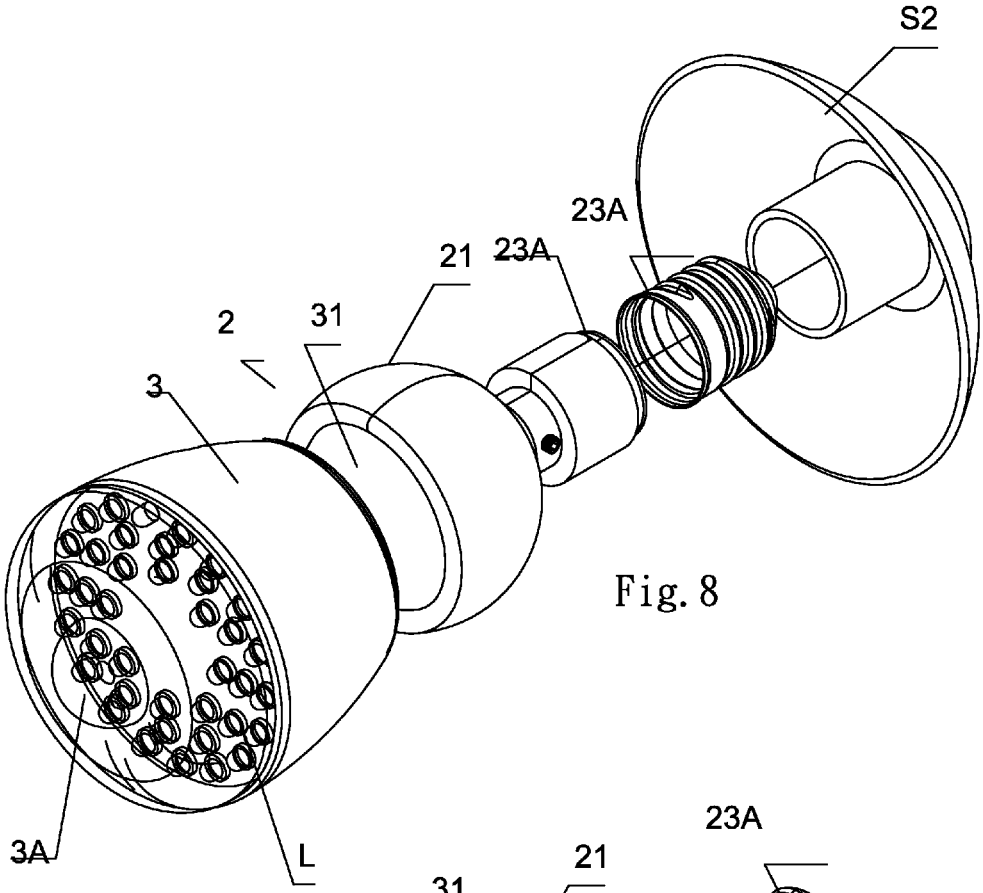
Fig. 8
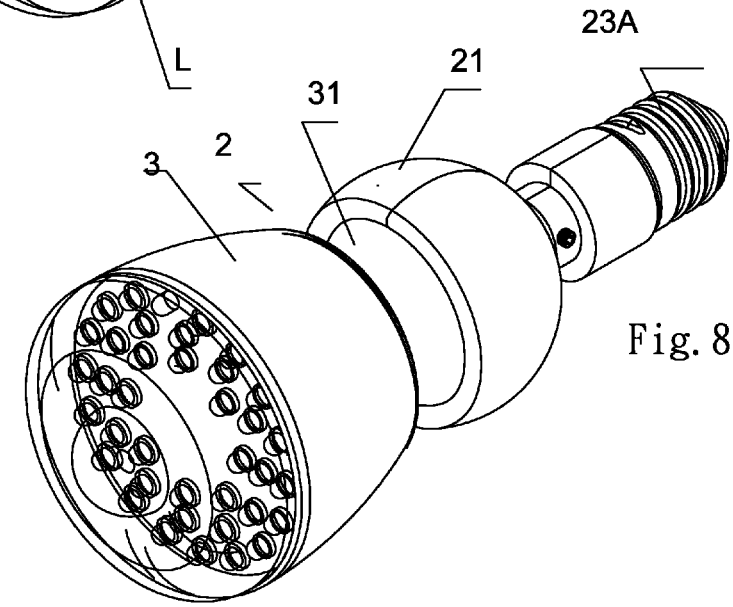
Fig. 8-A

ADJUSTABLE SENSE LAMP

BACKGROUND OF THE INVENTION

1. Field of the Invention

The present invention relates to an adjustable sense lamp, and more particularly to an adjustable sense lamp which comprises a bowl-shaped seat to connect with a power supply device and a lamp base having a light source, a sensor, a wire control panel and a power wire extending rearward. The sense lamp can be pulled upward and downward and turned to a desired angle.

2. Description of the Prior Art

A conventional bulb, lamp or illumination device uses a wiring line to connect a wall-mounted switch or a remote-controlled device to control the light source. For convenience and safety, various sense devices are developed. For example, an external sensor is connected in series to the middle of the power source of the illumination device. This way causes an inconvenience of installation and wire arrangement and occupies a space.

Recently, an improved sensor is coupled with the base of the illumination device. The advantage is that there is no need to add an additional circuit. The sense illumination device can be separately installed at a desired position, such as the exit of a stairway, a corner, or the like. The sense illumination device can be plugged in a power socket, without depending on a fixed and wall-mounted lamp or a ceiling light.

However, the base of the sense illumination device is limited to the position of the wall-mounted power socket so the sense direction of the sense illumination device is limited to the front of the wall-mounted power socket to influence the working range of the sensor. The sense illumination cannot be adapted for a special surrounding, angle or location, not having an expected exact sense effect.

Accordingly, the inventor of the present invention has devoted himself based on his many years of practical experiences to solve this problem.

SUMMARY OF THE INVENTION

The primary object of the present invention is to provide an adjustable sense lamp comprising a bowl-shaped seat and a lamp base. The bowl-shaped seat comprises a pair of semicircular seat pieces at a front section thereof to form a bowl trough, spaced grooves on an inner middle wall of each of the seat pieces to form an annular groove, and a stop portion formed between the grooves of the seat pieces. The rear section of the bowl-shaped seat is connected to a power supply device. The lamp base comprises a light source, a sensor, a wire control panel at a front end thereof and a power wire extending rearward. The lamp base further comprises a hollow ball-shaped head at a rear end thereof. The ball-shaped head has a pair of limit protrusions at two opposing sides thereof. The ball-shaped head at the rear end of the lamp base is located in the bowl-shaped trough formed between the two semicircular seat pieces of the bowl-shaped seat. The two seat pieces are adapted to clamp the ball-shaped head. The limit protrusions of the ball-shaped head are inserted in the annular groove before clamped and positioned. The power wire of the lamp base passes the ball-shaped head and the bowl-shaped seat to conduct with the power supply device.

When the lamp base is pulled, the limit protrusions in the annular groove will function as a support axle so that the ball-shaped head of the lamp base clamped in the bowl-shaped trough can be adjusted to a desired angle.

Preferably, the rear section of the bowl-shaped seat has a receiving opening which is adapted to connect a power plug to be plugged in a power socket.

Preferably, the rear section of the bowl-shaped seat has a concave ring formed on an outer wall thereof to be screwed to a connector of a lamp holder.

BRIEF DESCRIPTION OF THE DRAWINGS

FIG. 5-A is a schematic view showing adjustment according to the preferred embodiment of the present invention;

FIG. 5-B is an exploded view showing the bowl-shaped seat according to the preferred embodiment of the present invention;

FIG. 6-A is a schematic view showing turning according to the preferred embodiment of the present invention;

FIG. 6-B is a top view showing turning according to the preferred embodiment of the present invention;

FIG. 8 is an exploded view according to another embodiment of the present invention; and FIG. 8-A is a perspective view of FIG. 8A.

DETAILED DESCRIPTION OF THE PREFERRED EMBODIMENTS

Figure 1:
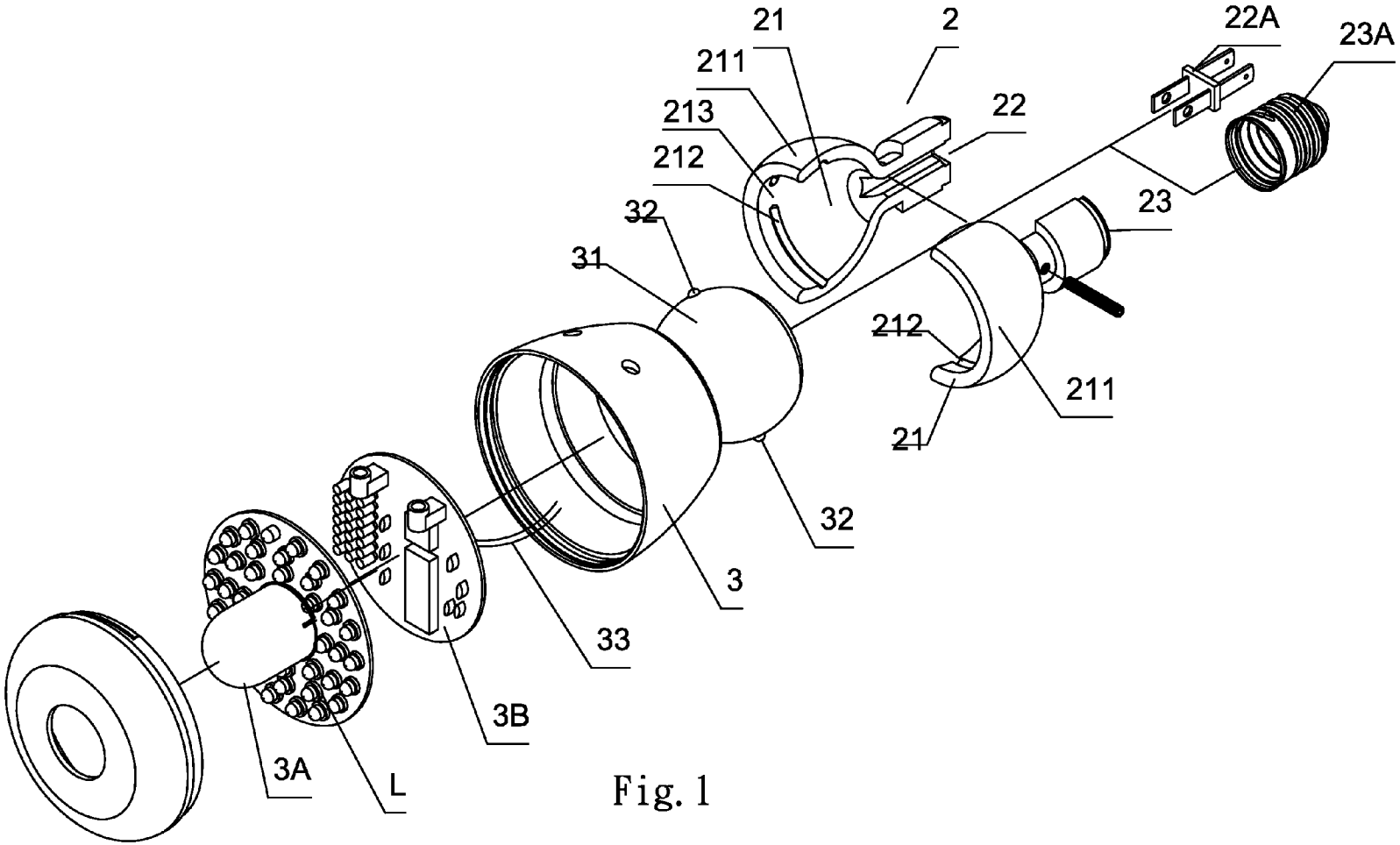
FIG. 1 is an exploded view according to a preferred embodiment of the present invention.
Figure 2:
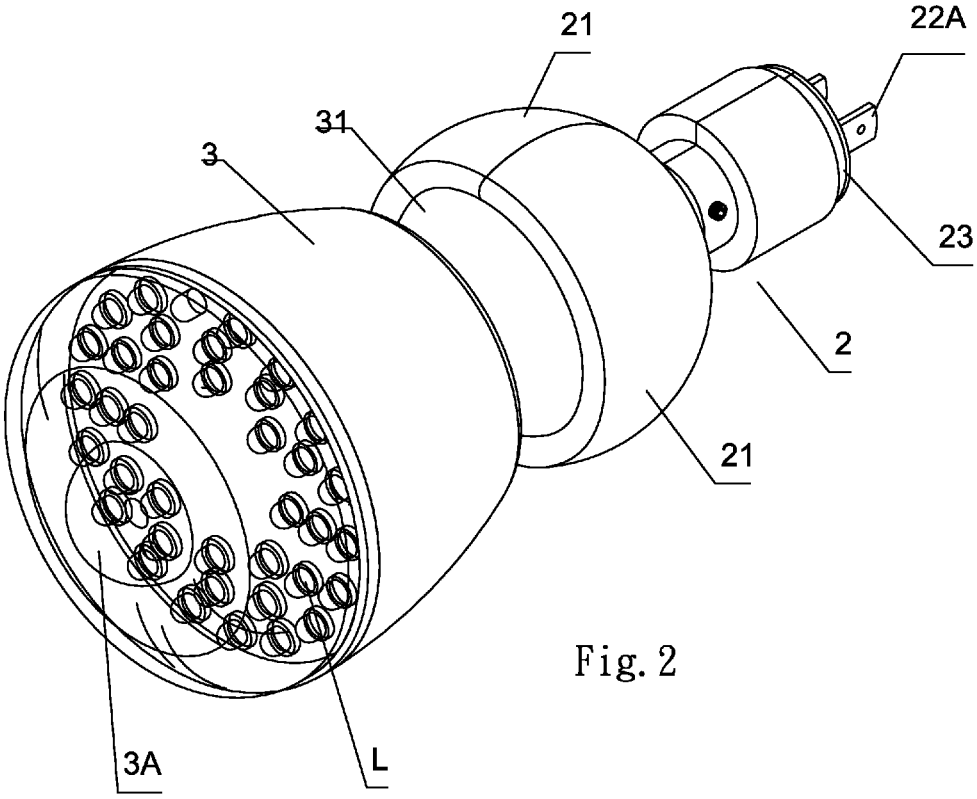
FIG. 2 is a perspective view according to the preferred embodiment of the present invention.
Figure 3:
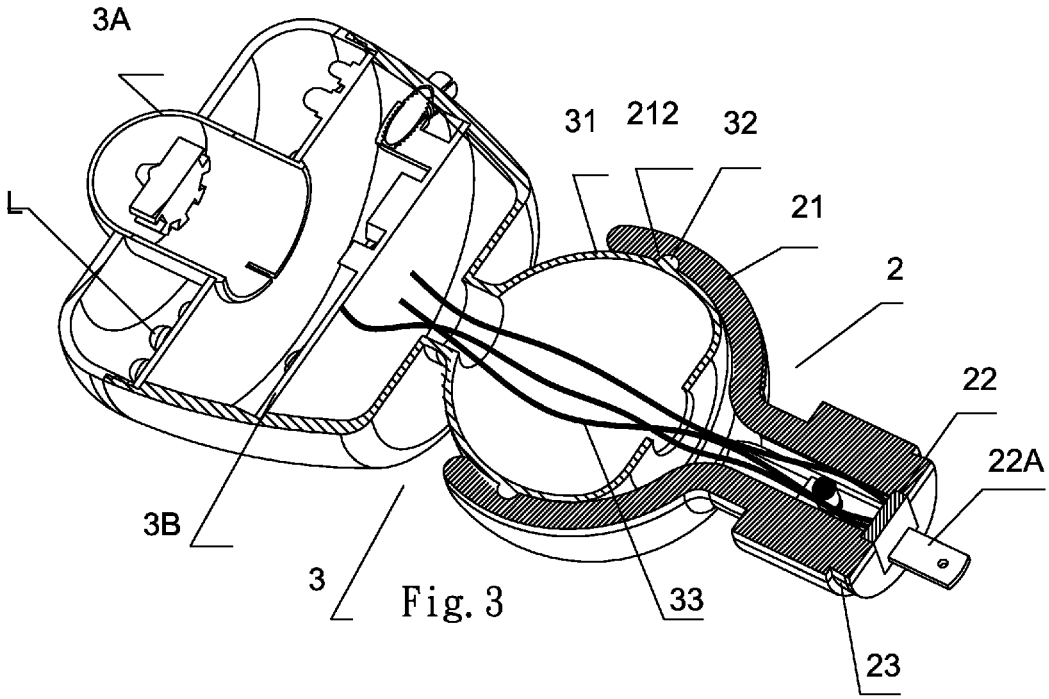
FIG. 3 is a sectional view according to the preferred embodiment of the present invention.
Figure 4:
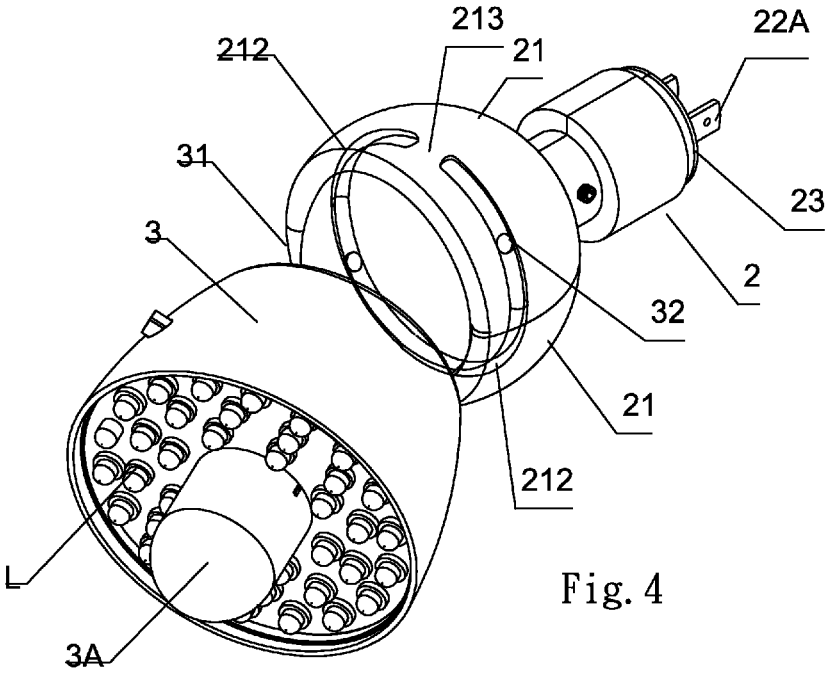
FIG. 4 is a schematic view of FIG. 2 in an adjustment state.

Embodiments of the present invention will now be described, by way of example only, with reference to the accompanying drawings.

As shown in FIG. 1, FIG. 2, FIG. 3 and FIG. 4, the present invention comprises a bowl-shaped seat 2 and a lamp base 3.

The bowl-shaped seat 2 comprises a pair of semicircular seat pieces 21 at a front section thereof to form a bowl trough 211, spaced grooves 212 on the inner middle wall of each of the seat pieces 21 to form an annular groove, a stop portion 213 between the grooves 212 of the seat pieces 21. The rear section of the bowl-shaped seat 2 is direct connected to a power supply device. The rear section of the bowl-shaped seat 2 has a receiving opening 22 which is adapted to connect a power plug 22A to be plugged in a power socket 51. As shown in FIG. 8 and FIG. 8-A, the rear section of the bowl-shaped seat 2 has a concave ring on an outer wall thereof to be screwed to a connector 23A of a lamp holder S2.

The lamp base 3 comprises a light source L (LED, a bulb or the like), a sensor 3A, a wire control panel 3B at a front end thereof and a power wire 33 extending rearward to connect with the power plug 22A, the connector 23A or the power supply device. The lamp base 3 further comprises a hollow ball-shaped head 31 at a rear end thereof. The ball-shaped head 31 has a pair of limit protrusions 32 at two opposing sides thereof.

The ball-shaped head 31 at the rear end of the lamp base 3 is located in the bowl-shaped trough 211 formed between the two semicircular seat pieces 21 of the bowl-shaped seat 2. The two seat pieces 21 are adapted to clamp the ball-shaped head 31. The limit protrusions 32 of the ball-shaped head 31 are inserted in the annular groove 212 before clamped and positioned. The power wire 33 of the lamp base 3 passes the ball-shaped head 31 and the middle of the bowl-shaped seat 2 to conduct with the power supply device to be plugged in the power socket S1 (as shown in FIG. 7) or screwed to the lamp holder S2 (as shown in FIG. 7, FIG. 8 and FIG. 8-A), providing an automatic sense illumination lamp.

Referring to FIG. 5-A and FIG. 5-B, when the lamp base 3 is vertically pulled, the limit protrusions 32 in the annular groove 211 functions as a support axle, such that the ball-shaped head 31 of the lamp base 3 clamped in the bowl-shaped trough 211 can be adjusted to an angle. The angle is limited when the lamp base 3 is against the top edge or the bottom edge of the bowl-shaped seat 2. The angle to be adjusted upward or downward is large, cooperating with the wide detection range of the sensor 3A to provide a desired inclined angle.

Referring to FIG. 6-A, FIG. 6-B, when the lamp base 3 is rotated, the limit protrusions 32 will slide along the annular groove 211, such that the ball-shaped head 31 of the lamp base 3 clamped in the bowl-shaped trough 211 is turned and adjusted to an angle. The turning angle is stopped when one of the limit protrusions 32 is contact with the stop portion 213 of the annular groove 212. In this way, the power wire 33 of the lamp base 3 can be protected and won't be damaged because continuous turning. The lamp base 3 can be turned about 360 degrees, cooperating with the wide detection range of the sensor 3A to provide a desired inclined angle.

Figure 7:
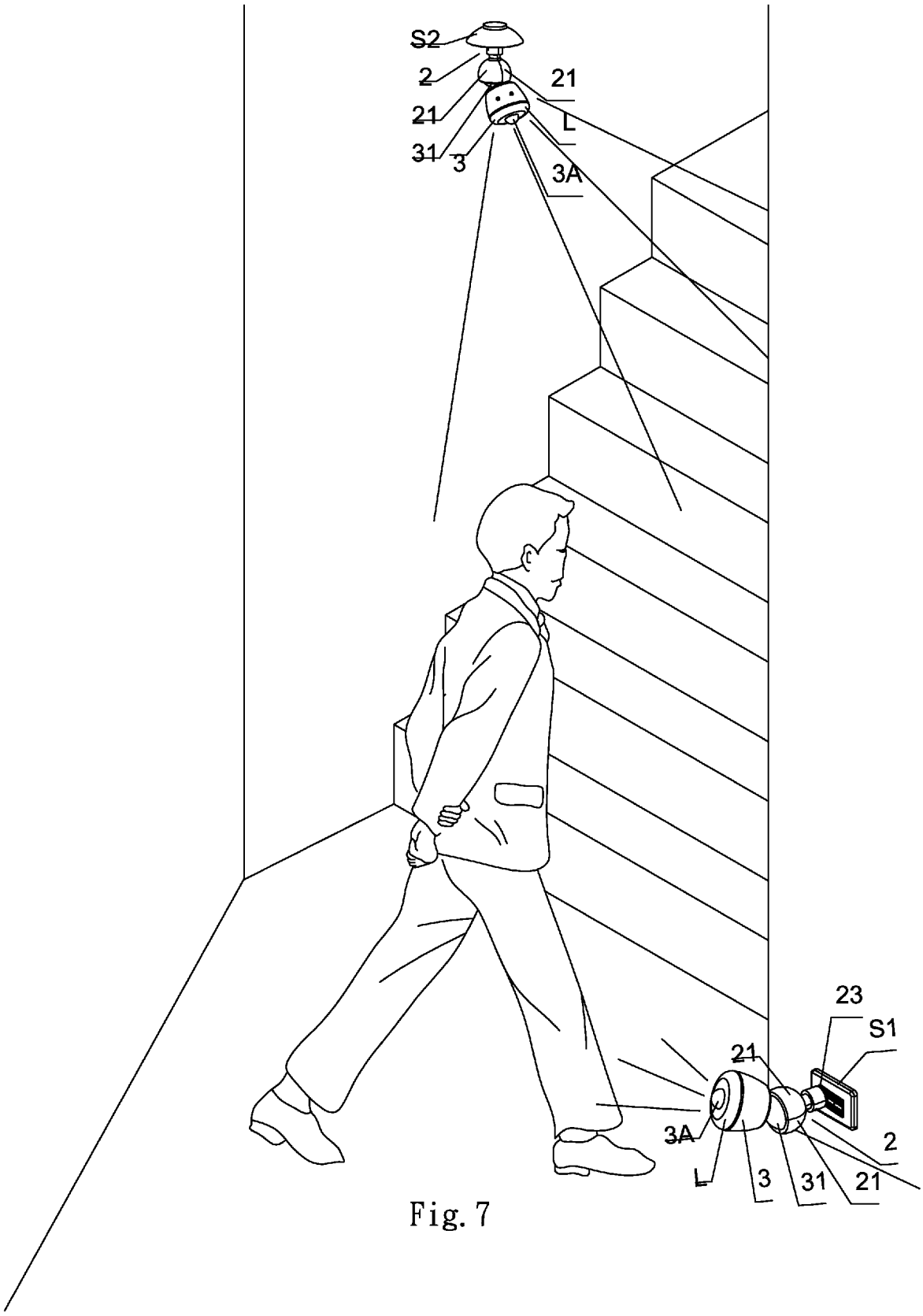
FIG. 7 is a schematic view of the preferred embodiment of the present invention when in use.

As shown in FIG. 7, the sense lamp can be adjusted according to the location that the sense lamp is installed for various demands. The sense lamp is plugged in the socket S1 to conduct with the power source, and then the lamp base 3 can be pulled or turned to a desired angle after adjustment.

As shown in FIG. 8 and FIG. 8-A, for the wall-mounted lamp holder S2, the rear section of the bowl-shaped seat 2 is connected with the standardization connector 23A, such that the sense lamp can be direct inserted in the lamp holder S2, achieving the same effect that the lamp base 3 can be pulled or turned to a desired angle after adjustment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An adjustable sense lamp, comprising a bowl-shaped seat comprising a pair of semicircular seat pieces at a front section thereof to form a bowl trough, spaced grooves on an inner middle wall of each of the seat pieces to form an annular groove, a stop portion between the grooves of the seat pieces, a rear section of the bowl-shaped seat being connected to a power supply device;

wherein the rear section of the bowl-shaped seat has a concave ring on an outer wall thereof to be screwed to a connector of a lamp holder; and a lamp base comprises a light source, a sensor, a wire control panel at a front end thereof and a power wire extending rearward, the lamp base further comprising a hollow ball-shaped head at a rear end thereof, the ball-shaped head having a pair of limit protrusions at two opposing sides thereof;

the ball-shaped head at the rear end of the lamp base being located in the bowl-shaped trough formed between the two semicircular seat pieces of the bowl-shaped seat, the two seat pieces being adapted to clamp the ball-shaped head, the limit protrusions of the ball-shaped head being inserted in the annular groove before clamped and positioned, the power wire of the lamp base passing the ball-shaped head and the bowl-shaped seat to conduct with the power supply device;

wherein, when the lamp base is pulled, the limit protrusions in the annular groove functions as a support axle so that the ball-shaped head of the lamp base clamped in the bowl-shaped trough can be adjusted to a desired angle.

* * * * *